US008264428B2

(12) United States Patent
Nam

(10) Patent No.: US 8,264,428 B2
(45) Date of Patent: Sep. 11, 2012

(54) PIXEL DRIVING METHOD AND APPARATUS FOR ORGANIC LIGHT EMITTING DEVICE

(75) Inventor: Woo-Jin Nam, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 679 days.

(21) Appl. No.: 12/003,627

(22) Filed: Dec. 28, 2007

(65) Prior Publication Data

US 2009/0079679 A1 Mar. 26, 2009

(30) Foreign Application Priority Data

Sep. 20, 2007 (KR) ..... 10-2007-0096141

(51) Int. Cl.
*G09G 3/30* (2006.01)

(52) U.S. Cl. ..... 345/76; 315/169.3

(58) Field of Classification Search ..... 345/76–83; 315/169.3

See application file for complete search history.

(56) References Cited

U.S. PATENT DOCUMENTS

| | | | | |
|---|---|---|---|---|
| 7,122,969 | B2 * | 10/2006 | Fukumoto et al. | 315/169.3 |
| 7,492,345 | B2 | 2/2009 | Jin et al. | 345/102 |
| 7,936,322 | B2 * | 5/2011 | Chung et al. | 345/82 |
| 2003/0111966 | A1 | 6/2003 | Mikami et al. | 315/169.3 |
| 2004/0155574 | A1 | 8/2004 | Lai et al. | 313/504 |
| 2005/0269958 | A1 * | 12/2005 | Choi et al. | 315/169.3 |
| 2005/0280614 | A1 * | 12/2005 | Goh | 345/76 |
| 2006/0007072 | A1 | 1/2006 | Choi et al. | 345/76 |
| 2006/0038754 | A1 * | 2/2006 | Kim | 345/76 |
| 2006/0139253 | A1 * | 6/2006 | Choi et al. | 345/76 |
| 2006/0145965 | A1 * | 7/2006 | Choi et al. | 345/76 |
| 2006/0262051 | A1 | 11/2006 | Kim et al. | 345/76 |
| 2006/0267884 | A1 * | 11/2006 | Takahashi et al. | 345/76 |
| 2007/0018917 | A1 * | 1/2007 | Miyazawa | 345/76 |
| 2007/0046587 | A1 * | 3/2007 | Takahara | 345/76 |
| 2007/0210998 | A1 * | 9/2007 | Chiou et al. | 345/82 |
| 2007/0216315 | A1 * | 9/2007 | Kawabe | 315/169.3 |
| 2007/0279337 | A1 * | 12/2007 | Kim et al. | 345/76 |

FOREIGN PATENT DOCUMENTS

| | | |
|---|---|---|
| CN | 1427388 A | 7/2003 |
| CN | 1628262 | 6/2005 |
| CN | 1704995 A | 12/2005 |
| CN | 1866339 | 11/2006 |

(Continued)

OTHER PUBLICATIONS

Yen-Chung Lin et al., "Improvement of Brightness Uniformity by AC Driving Scheme for AMOLED Display," *IEEE Electron Device Letters*, vol. 25, No. 11, Nov. 2004, pp. 728-730.

(Continued)

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A pixel driving method for an organic light emitting device includes charging a data voltage supplied through a data line to a storage capacitor and driving an N-channel switching transistor while cutting off supply of an upper power supply voltage to an organic light emitting diode; and powering the organic light emitting diode emit light by driving the N-channel driving transistor by the data voltage charged onto the storage capacitor while supplying the upper power supply voltage to the light emitting diode.

9 Claims, 11 Drawing Sheets

FOREIGN PATENT DOCUMENTS

| | | | |
|---|---|---|---|
| CN | 1965341 | A | 5/2007 |
| KR | 10-2007-0071725 | | 7/2007 |
| TW | 558701 | B | 10/2003 |
| WO | WO 01/31624 | A1 | 5/2001 |
| WO | WO 03/107083 | | 12/2003 |
| WO | WO 2005/122120 | A2 | 12/2005 |
| WO | WO 2006/126703 | A2 | 11/2006 |

OTHER PUBLICATIONS

Matias Troccoli et al., "AMOLED Display Pixel Electronics," *Organic Electroluminescence*, CRC Press, 2005, pp. 375-377.

Chinese Office Action dated Oct. 10, 2011, issued in a corresponding Chinese patent application.

* cited by examiner

PIXEL DRIVING METHOD AND APPARATUS FOR ORGANIC LIGHT EMITTING DEVICE

CROSS-REFERENCE TO RELATED APPLICATION

The present disclosure relates to subject matter contained in priority Korean Application No. 10-2007-0096141, filed on Sep. 20, 2007, which is hereby incorporated by reference in its entirety.

BACKGROUND OF THE INVENTION

1. Field of the Invention

The present disclosure relates to a method for driving a display panel, and more particularly, to a pixel driving method and apparatus for an organic light emitting device (OLED). Although embodiments of the invention are suitable for a wide scope of applications, it is particularly suitable for preventing a non-uniform brightness due to different levels of a common voltage at different positions within a display panel, and for preventing a flicker phenomenon due to a short data voltage emission period in a large display panel.

2. Description of the Related Art

Generally, an organic light emitting device (OLED) is a plane-type light emitting device. In an OLED, an organic light emitting layer is disposed between two electrodes facing each other so that when a voltage is applied between the two electrodes, electrons injected from one electrode are combined with holes injected from another electrode in the organic light emitting layer. As a result of the combination, molecules in the light emitting layer are excited such that light is emitted. Presently, the OLED is seen as the next generation of display apparatus due to its excellent viewing characteristics, light weight, thin thickness, and low voltage driving. The OLED is classified as either an Active-Matrix type OLED or a Passive-Matrix type OLED according to whether a switching device is provided in each of the unit pixels of a display panel.

FIG. 1A is a block diagram showing an OLED in accordance with the related art. As shown in FIG. 1A, the related art OLED includes a scan driving unit 10 for sequentially outputting scan signals to drive scan lines S1-Sn on a display panel 30 under control of a signal controller (not shown); a data driving unit 20 for outputting data voltages to data lines D1-Dm on the display panel 30; and a display panel 30 having a plurality of pixels PXs at intersections between the scan lines S1-Sn and the data lines D1-Dm. The pixels of the active-matrix type OLED are driven by one of voltage writing, current writing and digital writing.

FIG. 1B is a circuit for driving pixels PXs on the display panel 30 of FIG. 1A. As shown in FIG. 1B, the pixel circuit includes a switching transistor T11 transmitting data voltages DATA supplied through the data lines D to a storage capacitor C11 by being driven by the scan signals SCAN supplied through the scan lines S; the storage capacitor C11 for being charged to the data voltage DATA is also connected between a gate terminal of a driving transistor T12 and a lower power supply voltage terminal Vss; a driving transistor T12 supplies a driving current to an organic light emitting diode OLED 11 having a brightness corresponding to the driving current by having an anode connected to an upper power supply ELVDD voltage terminal and having a cathode connected to a drain of the driving transistor T12. The driving current corresponds to the data voltage DATA charged onto the storage capacitor C11. The transistors T11 and T12 are implemented as N-channel type thin film transistors (TFTs).

FIG. 2 is a waveform of FIGS. 1A and 1B. FIG. 3 is a schematic view showing an arrangement structure of power supply voltage supply lines on a display panel. The operation of the related art circuit for driving pixels shown in FIGS. 1A and 1B will be explained with reference to FIGS. 2 and 3.

In each frame period as shown in FIG. 2, positive scan signals Scan [1]-Scan [N] are sequentially supplied from the scan driving unit 10 to the scan lines S1-Sn on the display panel 30, thereby driving the pixels PXs on a corresponding scan line (horizontal line). As also shown in FIG. 2, an upper power supply voltage ELVDD of a certain level (i.e., 15V) is continuously supplied to the anode of the OLED 11 for one frame period. FIG. 1B is an exemplary view showing just one of a plurality of pixels (including a driving circuit) connected to an optional scan line.

The switching transistor T11 is turned ON by a corresponding scan signal among the scan signals Scan [1]-Scan [N]. The data voltage DATA supplied from the data driving unit 20 through a corresponding data line among the data lines D1-Dm charges the storage capacitor C11 through the switching transistor T11, and is maintained for a data voltage emission period. The driving transistor T12 is turned ON by the data voltage DATA charged onto the storage capacitor C11, and a certain amount of driving current corresponding to the data voltage DATA flows through the OLED 11. Accordingly, the organic light emitting diode OLED 11 emits light with a brightness corresponding to the data voltage DATA.

The driving current $I_{OLED}$ flowing in the OLED 11 is expressed as the following equation 1.

$$I_{OLED} = \frac{1}{2} \cdot \frac{W}{L} \cdot C_{SINx} \cdot \{V_{DATA} - V_{SS} - V_{TH}\}^2 \quad \text{[Equation 1]}$$

Here, "L" denotes a channel length of the driving transistor T12, the "W" denotes a channel width of the driving transistor T12, the "$C_{SINx}$" is a capacitor component of a gate insulator, the "$V_{TH}$" denotes a threshold voltage, and the "$V_{DATA}$" is a data voltage charged onto the storage capacitor C11.

As shown in FIG. 3, a lower power supply voltage Vss supply line 32 is arrayed on an array portion 31 with a mesh structure so as to minimize a resistance. On each outer periphery of the array portion 31 and the display panel 30, other lower power supply voltage supply lines 33 and 34 having a wider width are arrayed, thereby smoothly supplying the lower power supply voltage Vss.

In a data voltage programming period, when data voltages are being charged onto the storage capacitors C11 of the pixels PXs inside the display panel 30, about 1 μA of current flows through the OLED 11 and the driving transistor T12. The current flows to the lower power supply voltage supply lines 33 and 34 through the lower power supply voltage supply line 32. Accordingly, the current flowing in the display panel 30 has a total amount corresponding to several tens of mA, and thus a potential on the lower power supply voltage supply line 32 is increased. The increased lower power supply voltage Vss' is expressed as the following equation 2.

$$V_{SS}' = V_{SS} + I_{OLED} \cdot R_{line} \quad \text{[Equation 2]}$$

The driving current $I_{OLED}$ of the OLED 11, and the resistance $R_{line}$ of the lower power supply voltage supply line 32 have different values depending on position inside of the display panel 30.

As the potential on the lower power supply voltage supply line 32 is increased, a driving voltage of the driving transistor T12 inside the pixel is lowered, thereby lowering a brightness of the OLED 11. As the lower power supply voltage Vss changes to Vss', the driving current $I_{OLED}$ of the OLED 11 is lowered, which is expressed as the following equation 3.

$$I_{OLED} = \frac{1}{2} \cdot \frac{W}{L} \cdot C_{SINx} \cdot \{V_{DATA} - Vss' - V_{TH}\}^2 \leq \frac{1}{2} \cdot \frac{W}{L} \cdot C_{SINx} \cdot \{V_{DATA} - Vss - V_{TH}\}^2 \quad \text{[Equation 3]}$$

The potential on the lower power supply voltage supply line 32 is increased at the time of programming the data voltages due to the organic light emitting diode (OLED) of each pixel, the lower power supply voltage supply line 32 having a mesh structure, and the current flowing the lower power supply voltage supply line 32. Accordingly, the driving voltage of the driving transistor inside the pixel is lowered, thereby lowering brightness of the organic light emitting diode depending on the location of the pixel in the mesh. Since the brightness can be lowered at respective pixels by different levels, a non-uniform brightness can result in the overall display panel.

SUMMARY OF THE INVENTION

Accordingly, embodiments of the invention are directed to a pixel driving method and apparatus for an organic light emitting device that substantially obviates one or more of the problems due to limitations and disadvantages of the related art.

An object of embodiments of the invention is to provide a pixel driving method and apparatus for an organic light emitting device for preventing a driving voltage of a driving transistor inside a pixel from dropping.

Another object of the present disclosure is to provide a pixel driving method and apparatus for an organic light emitting device capable of sufficiently obtaining a data voltage programming period and a lighting duration of an organic light emitting diode regardless of a size of a display panel.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, there is provided a pixel driving method for an organic light emitting device includes: charging a data voltage supplied through a data line to a storage capacitor and driving an N-channel switching transistor while cutting off supply of an upper power supply voltage to an organic light emitting diode; and powering the organic light emitting diode emit light by driving the N-channel driving transistor by the data voltage charged onto the storage capacitor while supplying the upper power supply voltage to the light emitting diode.

According to another aspect, there is provided a pixel driving method for an organic light emitting device includes: charging a data voltage supplied through a data line to a storage capacitor and driving a P-channel switching transistor while cutting off supply of a lower power supply voltage to an organic light emitting diode; and powering the organic light emitting diode emit light by driving the P-channel driving transistor by the data voltage charged onto the storage capacitor while supplying the lower power supply voltage to the organic light emitting diode.

According to another aspect, there is provided a pixel driving apparatus for an organic light emitting device including: a first switching transistor for transmitting data voltages supplied through data lines to a storage capacitor by being driven by scan signals when an upper power supply voltage is cut off; a storage capacitor for being charged by the data voltage when the upper power supply voltage is cut off by being connected between a gate terminal of a driving transistor and a lower power supply voltage terminal; a driving transistor for supplying a driving current to an organic light emitting diode when the upper power supply voltage is supplied, the driving current corresponding to the data voltage charged onto the storage capacitor; a second switching transistor turned OFF when scan signals are supplied and connected between the cathode of the OLED and the drain of the driving transistor; an organic light emitting diode for emitting light with a brightness corresponding to the driving current by having an anode connected to the upper power supply voltage and a cathode connected to a drain of the second switching transistor.

According to yet another aspect, there is provided a pixel driving apparatus for an organic light emitting device including: a display panel having a plurality of display panel regions such that a plurality of adjacent scan lines can be included in each region; a plurality of diverged lower power supply voltages; and pixels inside each of the plurality of display panel regions share one lower power supply voltage among the plurality of lower power supply voltages.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to the preferred embodiments of the invention, examples of which are illustrated in the accompanying drawings.

Figure 4:
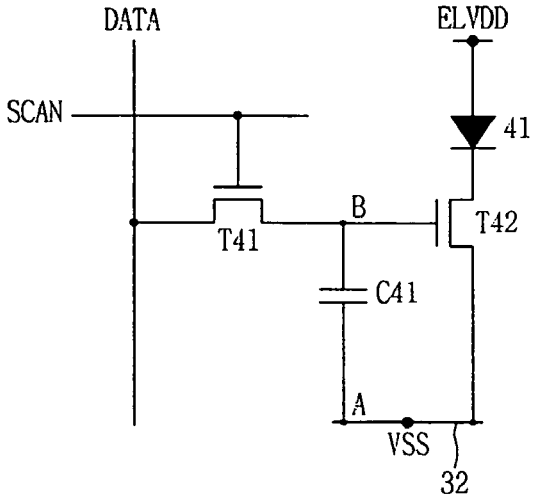
FIG. 4 is a view of a pixel circuit to which a pixel driving method according to embodiments of the invention can be applied.

FIG. 4 is a view of a pixel circuit to which a pixel driving method according to embodiments of the invention can be applied, which is implemented with an N-channel thin film transistor (TFT). FIG. 4 is an exemplary view showing just one of a plurality of pixels (including a driving circuit) arrayed on a horizontal line. As shown in FIG. 4, the pixel circuit includes a switching transistor T41 driven by scan signals for transmitting data voltages DATA supplied through data lines to a storage capacitor C41 when an upper power supply voltage ELVDD is cut off; a storage capacitor C41 connected between a gate terminal of a driving transistor T42 and a lower power supply voltage terminal Vss for be charged by the data voltage DATA when the upper power supply voltage ELVDD is cut off; a driving transistor T42 for supplying a driving current corresponding to the data voltage DATA charged onto the storage capacitor C41 to an organic light emitting diode OLED 41 when the upper power supply voltage ELVDD is supplied; and an organic light emitting diode OLED 41 having an anode connected to the upper power supply voltage ELVDD and a cathode connected to a drain of the driving transistor T42 for emitting light with a brightness corresponding to the driving current.

Figure 5:
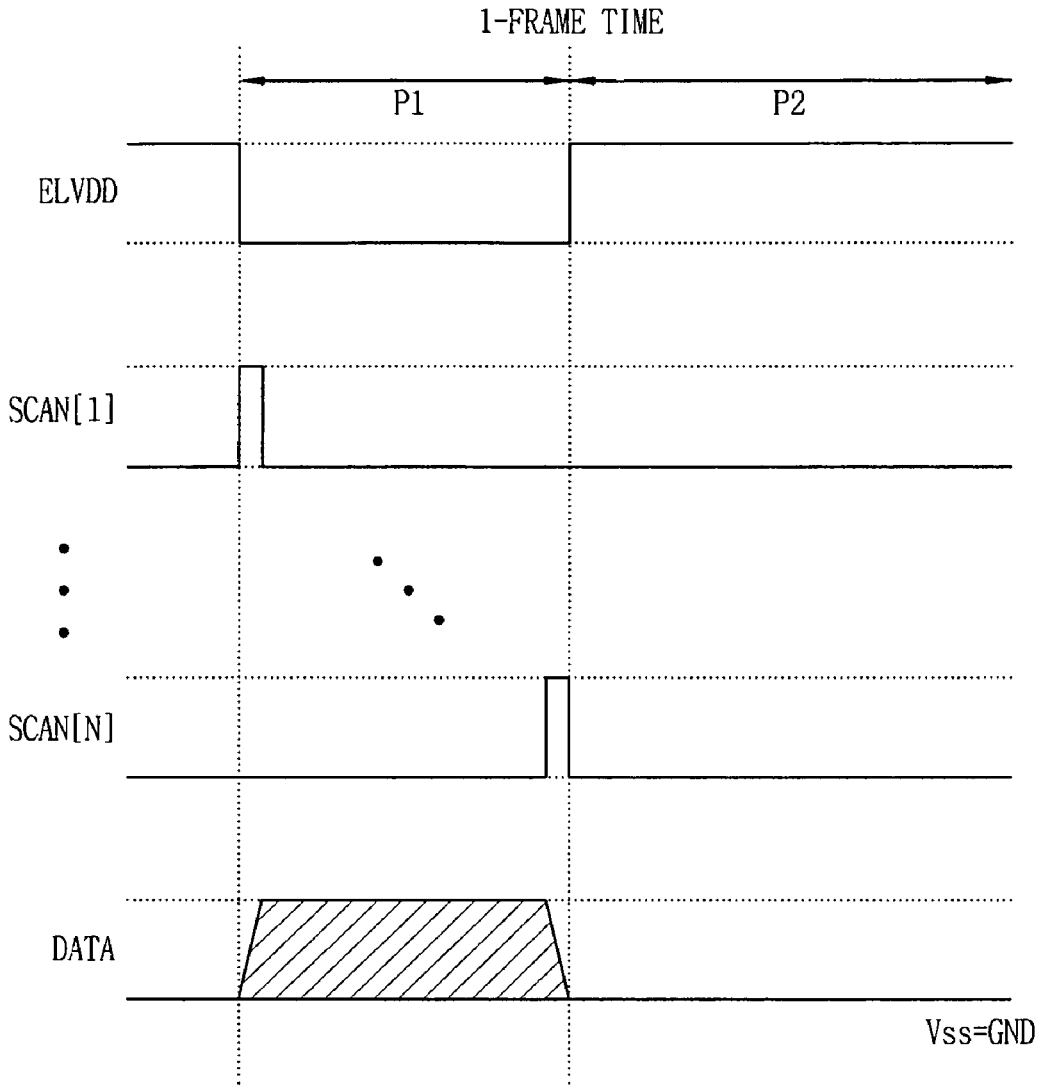
FIG. 5 is a waveform showing the pixel circuit of FIG. 4.

FIG. 5 is a waveform showing the pixel circuit of FIG. 4. Hereinafter, a pixel driving method on the pixel circuit will be explained in more detail with reference to FIG. 5. The ELVDD of a 'high' level is not supplied to the anode of the OLED 41 throughout one frame period. Instead, the ELVDD of a 'low' level (OV) is supplied during the data voltage programming period P1 of said one frame period. During the data voltage programming period P1, positive scan signals Scan[1]-Scan[N] are sequentially supplied to the respective horizontal lines, thereby driving the pixels on the horizontal lines. The driving of the pixels results in the data voltage DATA being supplied trough the corresponding data line to the storage capacitor C41 through the switching transistor T41 and being maintained for use during the data voltage emission period P2, shown in FIG. 5. During the data voltage programming period P1, the data voltage DATA of a 'high' level charged onto the storage capacitor C41 is also supplied to the gate terminal of the driving transistor T42 so as to turn on the driving transistor T42. However, since supply of the upper power supply voltage ELVDD to the anode of the OLED 41 is cut off, a voltage between drain and source terminals Vds is 'OV'. Accordingly, a current does not flow to the lower power supply voltage Vss supply line 32 through the OLED 41 and the driving transistor T42. That is, the driving current $I_{OLED}$ of the OLED 41 is '0.' Since the current does not flow to the lower power supply voltage supply line 32 through the OLED 41, a voltage of a lower power supply voltage node A is maintained as the original level (OV) regardless of a resistance of the lower power supply voltage supply line 32. Accordingly, the data voltage DATA having a desired level can be charged onto the storage capacitor C41.

Next, when the data voltage programming operation (scanning operation) is completed, the switching transistor T41 is turned OFF such that a gate node B is in an electrical floating status.

Next, in the data voltage emission period P2, the ELVDD of a 'high' level is supplied to the anode of the OLED 41. Since the gate terminal of the driving transistor T42 is being supplied with the data voltage DATA stored on the storage capacitor C41, the driving transistor T42 is turned ON such that current flows to the lower power supply voltage supply line 32 through the OLED 41 and the driving transistor T42 and the OLED 41 emits light.

As all the pixels on the display panel 30 are operated, a large amount of current flows to the lower power supply voltage supply line 32. Accordingly, the voltage Vss of the lower power supply voltage node A is increased to Vss' in accordance with Ohm's law (V=IR). Since the switching transistor T41 is turned OFF, the gate node B is in an electrical floating status. Therefore, when the voltage Vss of the lower power supply voltage node A is increased to the Vss', the voltage of the gate node B is also increased by coupling through the storage capacitor C41. The voltage VB of the gate node B is expressed as the following equation 4.

$$V_B = \text{Data} \cdot [N] + Vss' - Vss \qquad \text{[Equation 4]}$$

A current flows to the lower power supply voltage node A through the OLED 41 and the driving transistor T42 from the supplied ELVDD during the data voltage emission period P2, and thus the voltage of the lower power supply voltage node A changes from the Vss to the Vss.' Although the voltage of the gate node B changes, a voltage Vgs between the gate and source terminals of the driving transistor T42 does not change. Accordingly, the driving current $I_{OLED}$ of the OLED 41 is not influenced by the voltage change of the lower power supply voltage node A, but is only influenced by the data voltage DATA stored in the storeage capacitor C41. The driving current $I_{OLED}$ of the OLED 41 is expressed as the following equation 5.

$$I_{OLED} = \frac{1}{2} \cdot \frac{W}{L} \cdot C_{SINx} \cdot \{V_B - Vss' - V_{TH}\}^2 = \frac{1}{2} \cdot \frac{W}{L} \cdot C_{SINx} \cdot \{\text{Data} \cdot [N] - Vss - V_{TH}\}^2 \qquad \text{[Equation 5]}$$

The following table shows each change of the voltages of the nodes A and B, and the driving current $I_{OLED}$ of the OLED 41 in the data voltage programming period P1 and the data voltage emission period P2.

| Operation | Period 1 | Period 2 |
|---|---|---|
| Node 'A' | Vss | Vss' (potential rising) |
| Node 'B' | Data · [N] | Data · [N] + Vss' − Vss |
| $I_{OLED}$ | 0 | $k \cdot (\text{Data} \cdot [N] - Vss - V_{TH})^2$ |

In the data voltage programming period P1 of one frame period, the supply of the ELVDD may be cut off by various methods so as to prevent a current from flowing to the lower power supply voltage Vss supply line 32 through the OLED 41 and the driving transistor T42.

Figure 6:
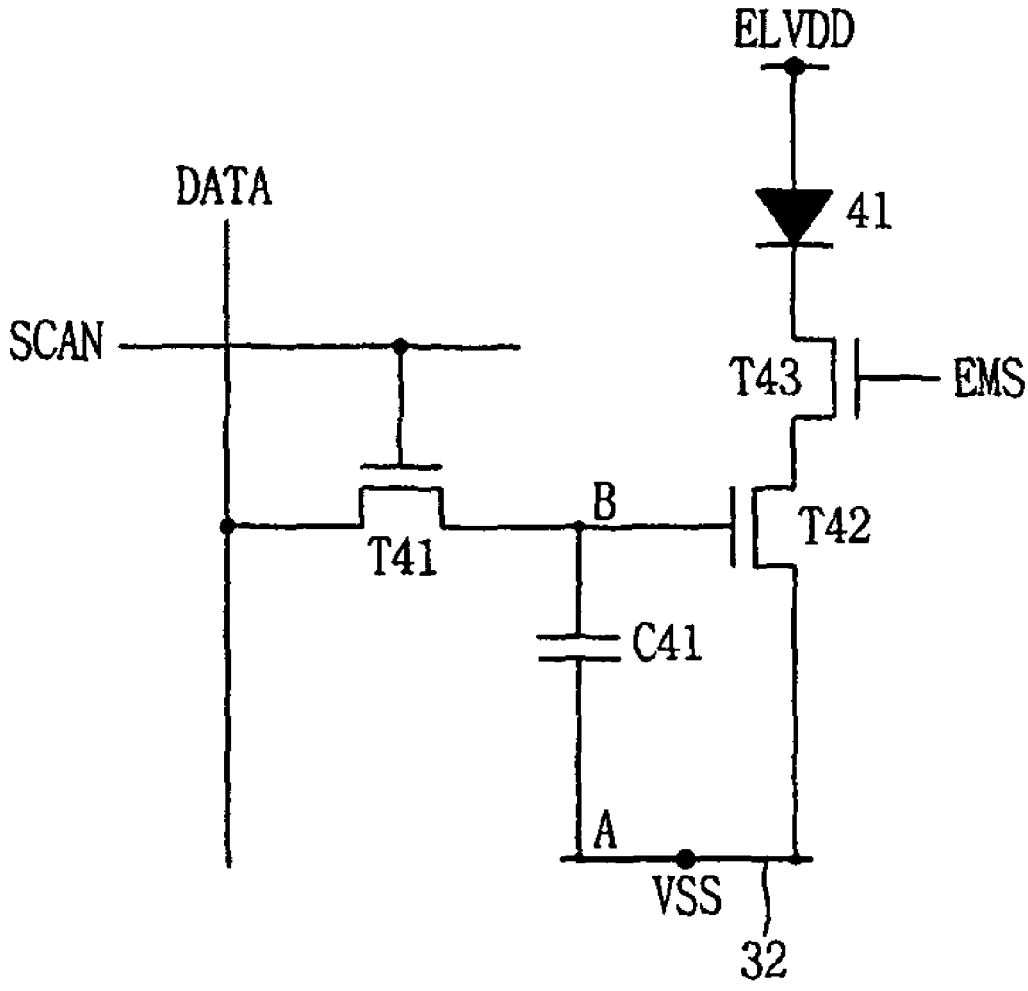
FIG. 6 is a view of another pixel circuit to which the pixel driving method according to embodiments of the invention can be applied.

FIG. 6 is a view of another pixel circuit to which the pixel driving method according to embodiments of the invention can be applied. FIG. 6 shows one method for cutting-off the supply of the ELVDD by using a switching transistor in each pixel. More specifically, a drain and a source of the switching transistor T43 are respectively connected between the cathode of the OLED 41 and the drain of the driving transistor T42. The switching transistor T43 is turned OFF with a switching control signal EMS of a 'low' level to the gate of the switching transistor T43 by a signal controller (not shown) during the data voltage programming period P1.

Figure 7:
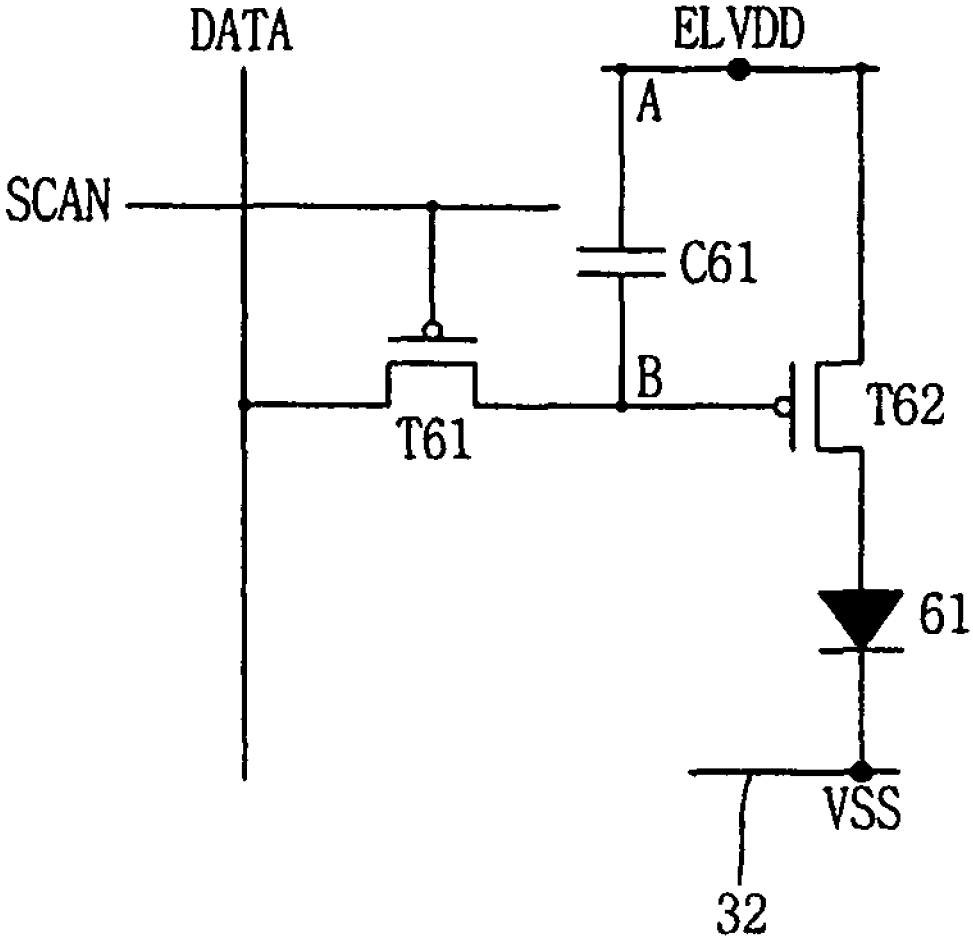
FIG. 7 is a view of still another pixel circuit to which the pixel driving method according to embodiments of the invention can be applied.

FIG. 7 is a view of still another pixel circuit to which the pixel driving method according to embodiments of the invention can be applied, which shows a P-channel type Thin Film Transistor (TFT). As shown in FIG. 7, the P-channel type TFT includes a switching transistor T61 driven by a scan signal for transmitting a data voltage DATA supplied through a data line to a storage capacitor C61 when a lower power supply voltage Vss is cut off; a storage capacitor C61 connected between a gate terminal of a driving transistor T62 and an upper power supply voltage terminal ELVDD is charged by the data voltage DATA when the lower power supply voltage Vss is cut off; a driving transistor T62 for supplying a driving current to an organic light emitting diode OLED 61 when the lower power supply voltage Vss is supplied; and an OLED 61 having an anode connected to a source terminal of the driving transistor T62 and having a cathode connected to the lower power supply voltage Vss for emitting light having a brightness corresponding to the driving current. The driving current corresponds to the data voltage DATA charged onto the storage capacitor C61. Hereinafter, a pixel driving method for the pixel circuit will be explained in more detail with reference to FIG. 8.

Figure 8:
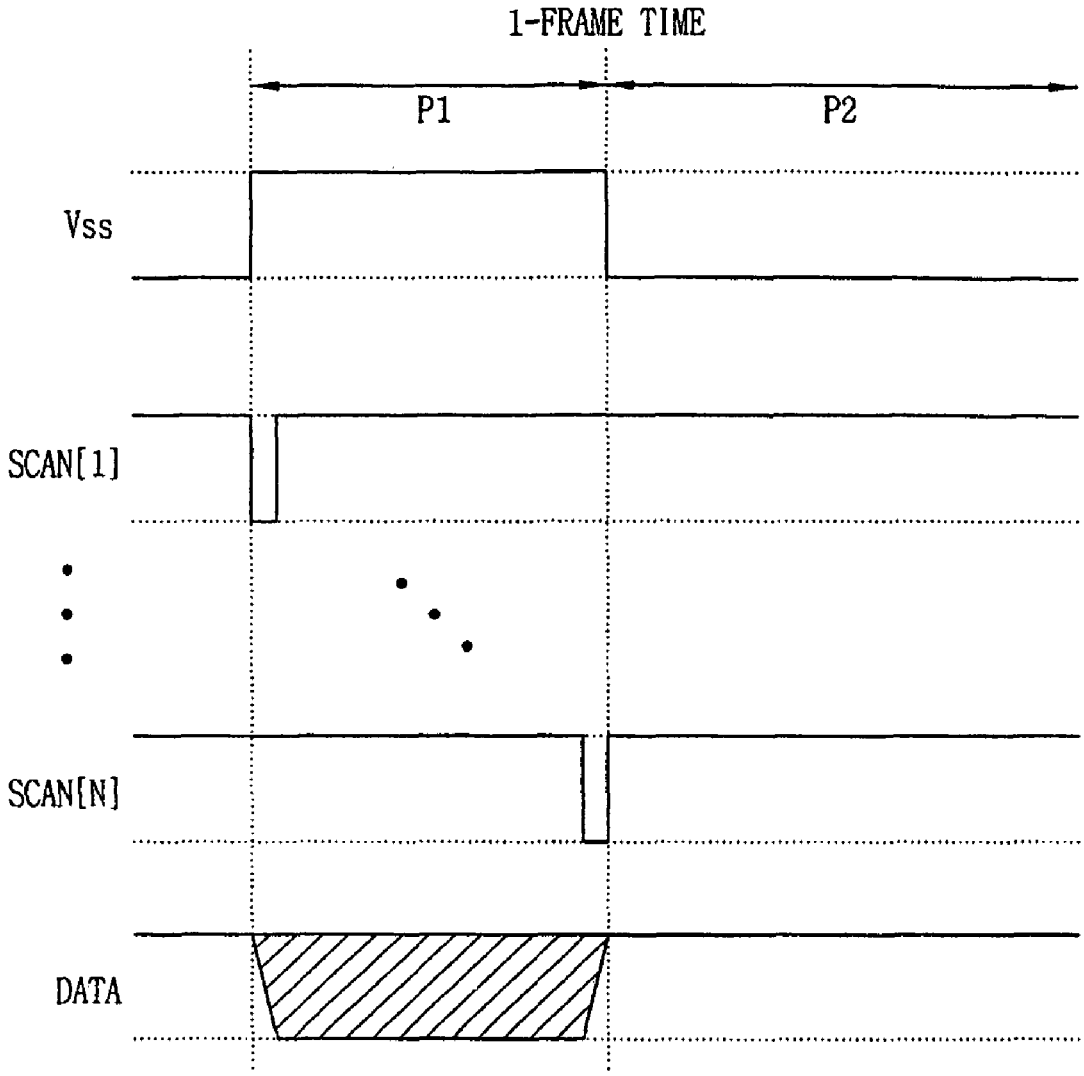
FIG. 8 is a waveform showing the pixel circuit of FIG. 7.

FIG. 8 is a waveform showing the pixel circuit of FIG. 7. The lower power supply voltage Vss of a 'low' level is not supplied to the cathode of the OLED 61 during all of one frame period. Instead, the Vss of a 'high' level is supplied during the data voltage programming period P1 of said one frame period. During the data voltage programming period P1, negative scan signals Scan[1]-Scan[N] are sequentially supplied to the respective horizontal lines, thereby driving the pixels on the horizontal lines. The driving of the pixels results in the data voltage DATA being supplied through the corresponding data line to the storage capacitor C61 through the switching transistor T61 and being maintained for use in the data voltage emission period P2, as shown in FIG. 8. During the data voltage programming period P1, the data voltage DATA of a 'low' level is charged onto the storage capacitor C61 and is also applied to the gate terminal of the driving transistor T62 so as to turn on the driving transistor T62. However, since the supply of the lower power supply voltage Vss to the cathode of the OLED 61 is cut off, a voltage between drain and source terminals Vds is 'OV' Accordingly, the current does not flow in the OLED 61 from the upper power supply voltage ELVDD supply line. That is, the driving current $I_{OLED}$ of the OLED 61 is '0.' Since the current does not flow in the OLED 61 from the upper power supply voltage ELVDD supply line, a voltage of an upper power supply voltage node A is maintained as the original level (15V) during the data voltage programming period P1 regardless of a resistance of the upper power supply voltage ELVDD supply line. Accordingly, the data voltage DATA having a desired level can be charged onto the storage capacitor C61.

Next, when the data voltage programming operation (scanning operation) is completed, the switching transistor T61 is turned OFF and thereby the gate node B is in an electrical floating status.

Next, in the data voltage emission period P2, the low power supply voltage Vss of a 'low' level (OV) is supplied to the cathode of the OLED 61. Since the gate terminal of the driving transistor T62 is being supplied with the data voltage DATA stored at the storage capacitor C61, the driving transistor T62 is turned ON so that the upper power supply voltage ELVDD is supplied to the OLED 61 and the OLED 61 emits light.

As all the pixels on the display panel 30 are operated, a large amount of current flows to upper power supply voltage supply line. Accordingly, the voltage VDD of the upper power supply voltage node A is decreased to VDD' according to the Ohm's law (V=IR). Since the switching transistor T61 is turned OFF, the gate node B is in an electrical floating status. Therefore, when the voltage VDD of the upper power supply voltage node A is lowered to the VDD', the voltage of the gate node B is also lowered due to coupling with the storage capacitor C61. The voltage VB of the gate node B is expressed as the following equation 6.

$$V_B = \text{Data}[N] + VDD' - VDD \qquad \text{[Equation 6]}$$

A current flows from the upper power supply voltage node A to the OLED 41 through the driving transistor T62 by the supplied lower power supply voltage Vss in the data voltage emission period P2, and thus the voltage of the upper power supply voltage node A changes from the VDD to the VDD'. However, since the voltage of the gate node B also changes, a voltage Vgs between the gate and source terminals of the driving transistor T62 does not change. Accordingly, the driving current $I_{OLED}$ of the OLED 61 is not influenced by the voltage change of the upper power supply voltage node A and is only influenced by the data voltage DATA stored in the storage capacitor C61. The driving current $I_{OLED}$ of the OLED 61 is expressed as the following equation 7.

$$I_{OLED} = \frac{1}{2} \cdot \frac{W}{L} \cdot C_{SINx}(V_B - VDD' - V_{TH})^2 = \frac{1}{2} \cdot \frac{W}{L} \cdot C_{SINx} \cdot \{V_{DATA}[N] - VDD - V_{TH}\}^2 \qquad \text{[Equation 7]}$$

The following table shows each change of the voltages of the nodes A and B and the driving current $I_{OLED}$ of the OLED 61 in the data voltage programming period P1 and the data voltage emission period P2.

| Operation | Period 1 | Period 2 |
|---|---|---|
| Node 'A' | VDD | VDD' (potential drop) |
| Node 'B' | Data · [N] | Data · [N] + VDD' − VDD |
| $I_{OLED}$ | 0 | k · (Data · [N] − VDD − $V_{TH}$)$^2$ |

To prevent a current from flowing to the lower power supply voltage Vss supply line 32 through the OLED 61 and the driving transistor T62 in the data voltage programming period P1 for one frame period supply of the upper power supply voltage ELVDD may be cut off by various methods.

Figure 9:
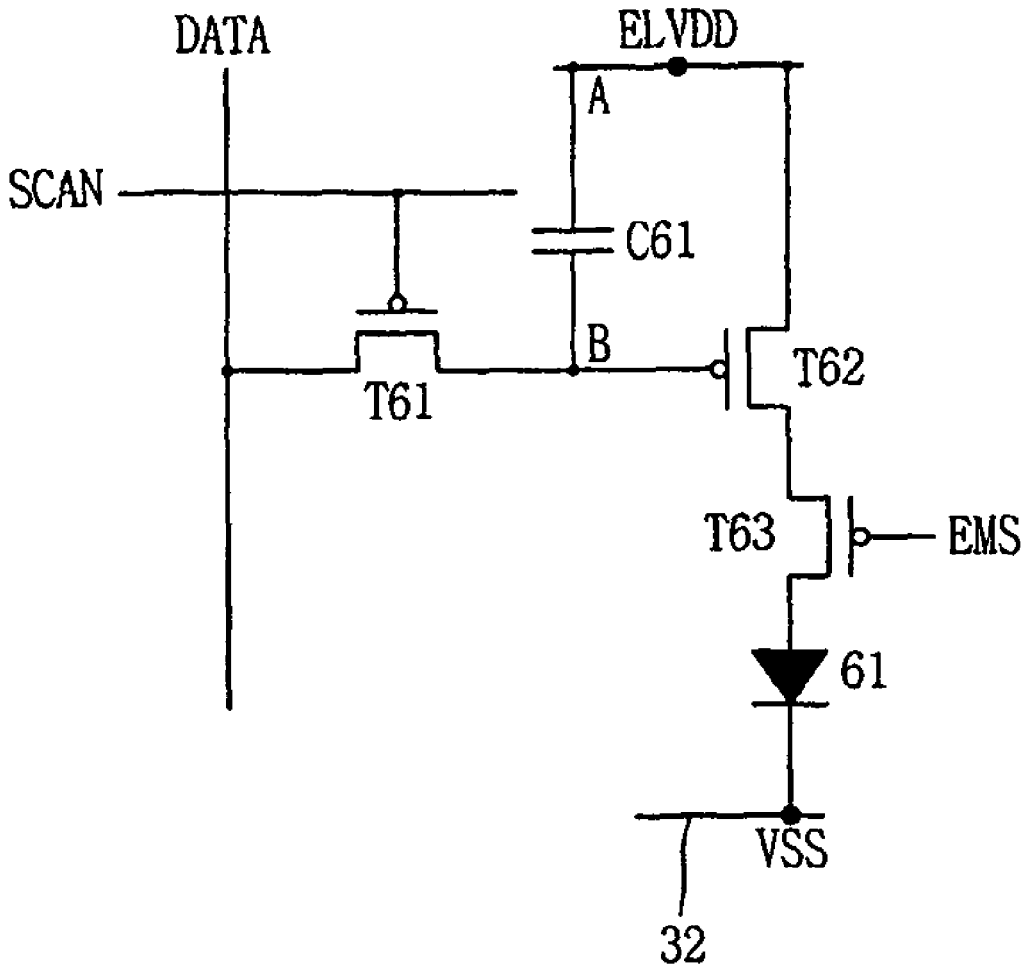
FIG. 9 is a view of yet another pixel circuit to which the pixel driving method according to embodiments of the invention can be applied.

FIG. 9 is a view of an additional pixel circuit to which the pixel driving method according to embodiments of the invention can be applied. More specifically, FIG. 9 shows a method for cutting-off supply of the ELVDD by using a switching transistor. A drain and a source of the switching transistor T63 are respectively connected between the anode of the OLED 61 and the drain of the driving transistor T62. The switching transistor T63 is turned OFF due to a switching control signal EMS of a 'high' level applied to the gate of the switching transistor T63 by a signal controller (not shown) in the data voltage programming period P1.

Figure 10:
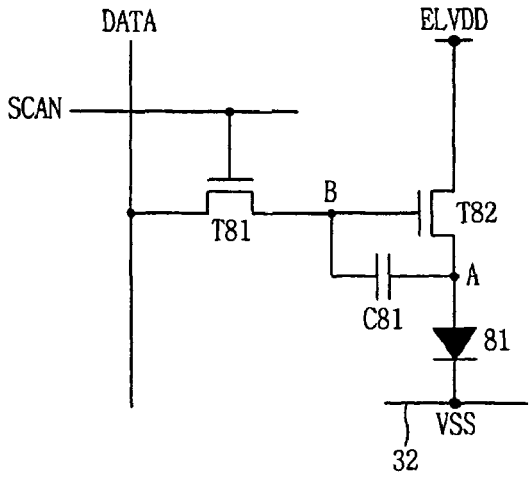
FIG. 10 is a view of an anode contact type-pixel circuit according to embodiments of the invention in which the driving transistor comes in contact with the anode of the organic light emitting diode.

FIG. 10 is a view of an anode contact type-pixel circuit according to embodiments of the invention in which the driving transistor comes in contact with the anode of the organic light emitting diode. As shown in FIG. 10, the pixel circuit according to embodiments of the invention includes a switching transistor T81 driven by a scan signal for transmitting a data voltage DATA supplied from a data line to a storage capacitor C81, when an upper power supply voltage ELVDD is cut off; a storage capacitor C81 connected between a gate terminal and a source terminal of a driving transistor T82 for being charged with the data voltage DATA when the upper power supply voltage ELVDD is cut off; a driving transistor T82 for supplying a driving current to the OLED 81 when the upper power supply voltage ELVDD is cut off; and an organic light emitting diode OLED 81 having an anode connected to the source terminal of the driving transistor T82 and a cathode connected to a lower power supply voltage terminal Vss for emitting light with a brightness corresponding to the driving current. The driving current corresponds to the data voltage DATA. Hereinafter, a pixel driving method at the pixel circuit will be explained in more detail with reference to FIG. 5.

The ELVDD of a 'high' level is not supplied to the drain of the driving transistor T82 during all of one frame period. Instead, the ELVDD of a 'low' level is supplied only during the data voltage programming period P1 of the one frame period. During the data voltage programming period P1, positive scan signals Scan[1]-Scan[N] are sequentially supplied to the respective horizontal lines, thereby driving the pixels on the horizontal lines. As a result of the pixels being driven, the data voltage DATA supplied through the corresponding data line is charged onto the storage capacitor C81 through the switching transistor T81 and is maintained for the data voltage emission period P2. The data voltage DATA of a 'high' level charged to the storage capacitor C81 is also supplied to the gate terminal of the driving transistor T82, thereby turning on the driving transistor T82. However, since supply of the upper power supply voltage ELVDD to the drain of the driving transistor T82 is cut off, a voltage between the drain and source terminals Vds becomes 'OV'. Accordingly, the current does not flow to the lower power supply voltage Vss supply line 32 through the OLED 81 and the driving transistor T82. That is, the driving current $I_{OLED}$ of the OLED 81 becomes '0.' Since the current does not flow to the lower power supply voltage supply line 32 through the OLED 81, a voltage of an anode node A is maintained as the original level Vss regardless of a resistance of the lower power supply voltage supply line 32. Accordingly, the data voltage DATA having a desired level can be charged onto the storage capacitor C81.

Next, when the data voltage programming operation (scanning operation) is completed, the switching transistor T81 is turned OFF and thereby the gate node B is in an electrical floating status.

Next, in the data voltage emission period P2, the ELVDD of a 'high' level is supplied to the driving transistor T82 in the data voltage emission period P2. Since the gate terminal of the driving transistor T82 is being supplied with the data voltage DATA stored at the storage capacitor C81 the driving transistor T82 is turned ON to allow current flow to the lower power supply voltage supply line 32 through the OLED 81 and the driving transistor T82 so that the OLED 81 emits light.

As all the pixels on the display panel 30 are operated, a large amount of current flows to the lower power supply voltage supply line 32. Accordingly, the voltage Vss of the anode node A is increased to $V_{OLED}$ according to the Ohm's law (V=IR). Since the switching transistor T81 is turned OFF, the gate node B is in an electrical floating status. Therefore, when the voltage Vss of the anode node A is increased to $V_{OLED}$, the voltage of the gate node B is also increased by coupling through the storage capacitor C81. The voltage $V_B$ of the gate node B is expressed as the following equation 8.

$$V_B = \text{Data}[N] + V_{OLED} - V_{SS} \quad \text{[Equation 8]}$$

A current flows to the lower power supply voltage supply line 32 through the OLED 81 and the driving transistor T82 by the supplied ELVDD in the data voltage emission period P2, and thus the voltage of the anode node A changes from the Vss to $V_{OLED}$. However, since the voltage of the gate node B also changes, a voltage Vgs between the gate and source terminals of the driving transistor T82 does not change. Accordingly, the driving current $I_{OLED}$ of the OLED 81 is not influenced by the voltage change of the anode node A, but is only influenced by the data voltage stored in the storage capacitor C81. The driving current $I_{OLED}$ of the OLED 81 is expressed as the following equation 9.

$$\begin{aligned} I_{OLED} &= \frac{1}{2} \cdot \frac{W}{L} \cdot C_{SINx} \cdot \\ &\quad \{\text{Data}[N] + V_{OLED} - V_{SS} - V_{OLED} - V_{TH}\}^2 \\ &= \frac{1}{2} \cdot \frac{W}{L} \cdot C_{SINx} \cdot \{\text{Data}[N] - V_{SS} - V_{TH}\}^2 \end{aligned} \quad \text{[Equation 9]}$$

The following table shows each change of the voltages of the nodes A and B, and the driving current $I_{OLED}$ of the OLED 81 in the data voltage programming period P1 and the data voltage emission period P2.

| Operation | Period 1 | Period 2 |
|---|---|---|
| Node 'A' | Vss | $V_{OLED}$ |
| Node 'B' | Data · [N] | Data · [N] + $V_{OLED}$ − Vss |
| $I_{OLED}$ | 0 | k · (Data · [N] − Vss − $V_{TH}$)$^2$ |

In the same manner as the aforementioned embodiments of the invention, the data voltage programming period P1 is set in one frame period, during which the data voltage is charged to the storage capacitor in a state that supply of the power supply voltage to the organic light emitting diode OLED is cut off. Accordingly, a driving voltage of the driving transistor is prevented from dropping.

Since time corresponding to the data voltage programming period P1 takes time from the data voltage emission period P2 in one frame period, lighting duration of the OLED is reduced. When embodiments of the invention are applied to a small type display panel 30 having relatively a small number of scan lines, the lighting duration of the organic light emitting diode can be sufficient without the need to reduce the data voltage programming period P1. When embodiments of the invention are implemented in a large display panel 30 having relatively a large number of scan lines (i.e., 768 scan lines), the data voltage programming period P1 becomes relatively long. Accordingly, there is a difficulty in obtaining sufficient lighting duration of the organic light emitting diode, and thus a brightness flicker phenomenon occurs. To solve this problem, the data voltage programming period and the lighting duration of the organic light emitting diode in additional embodiments of the invention are sufficiently obtained regardless of the size of the display panel. Hereinafter, the additional embodiments of the invention will be explained in more detail.

Figure 1A:
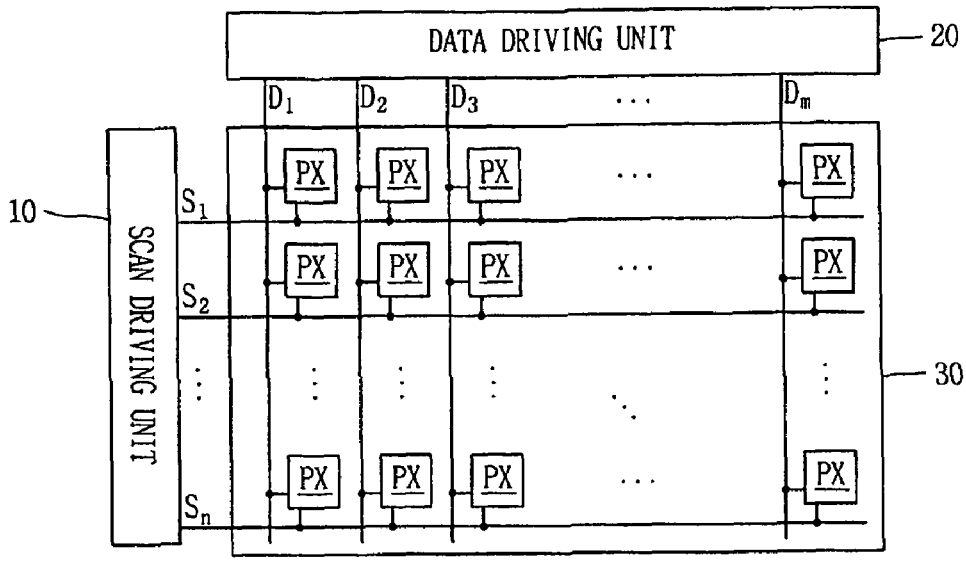
FIG. 1A RELATED ART
FIG. 1A is a block diagram showing an organic light emitting device (OLED) in accordance with the related art.
Figure 1B:
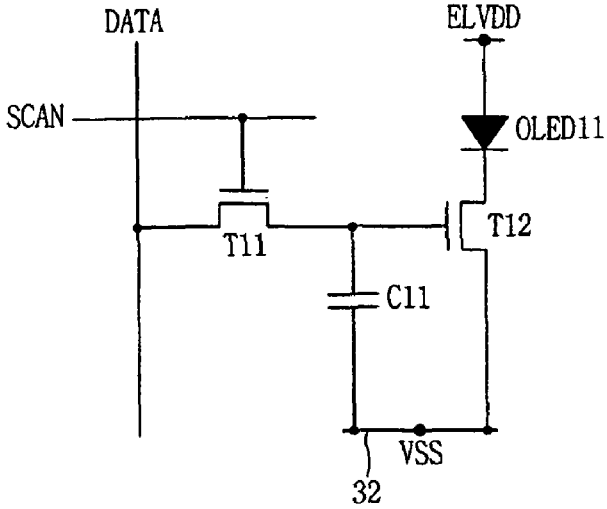
FIG. 1B RELATED ART
FIG. 1B is a pixel circuit in accordance with the related art.
Figure 2:
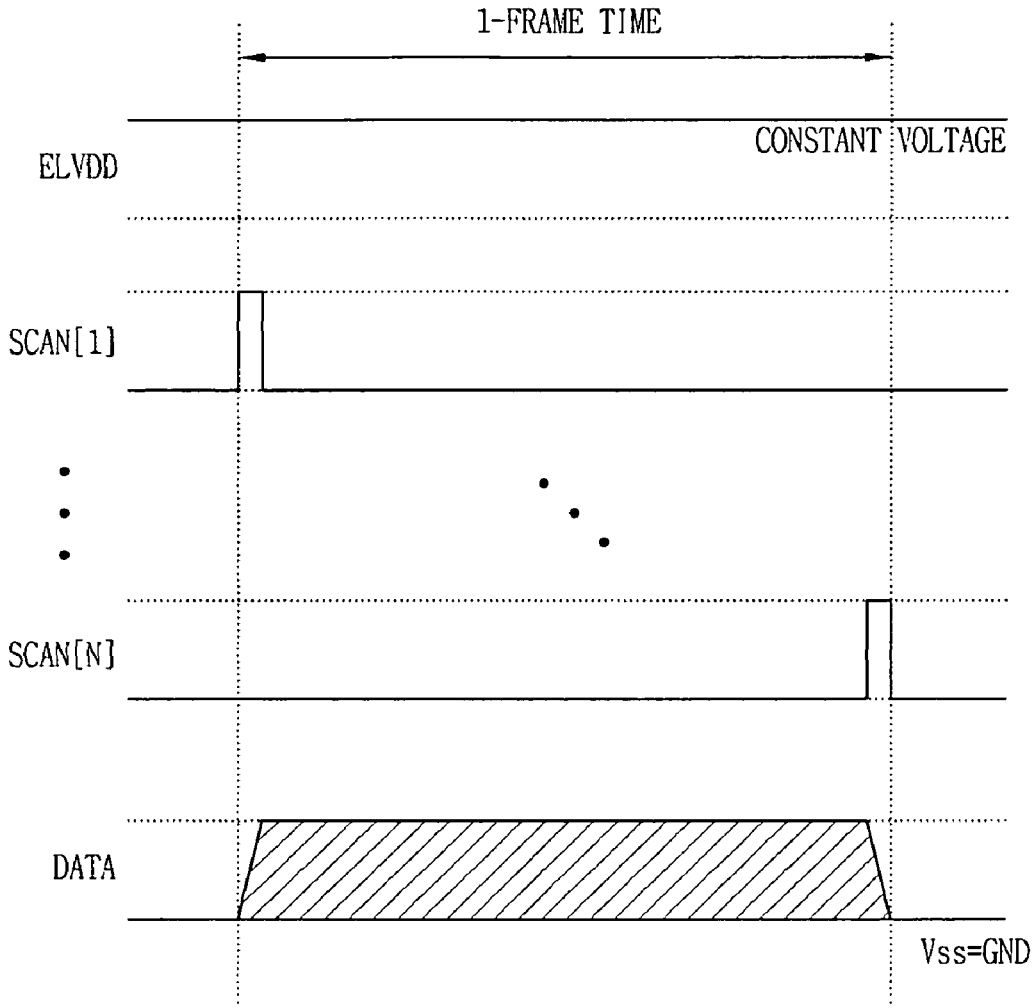
FIG. 2 RELATED ART
FIG. 2 is a waveform of FIGS. 1A and 1B.
Figure 3:
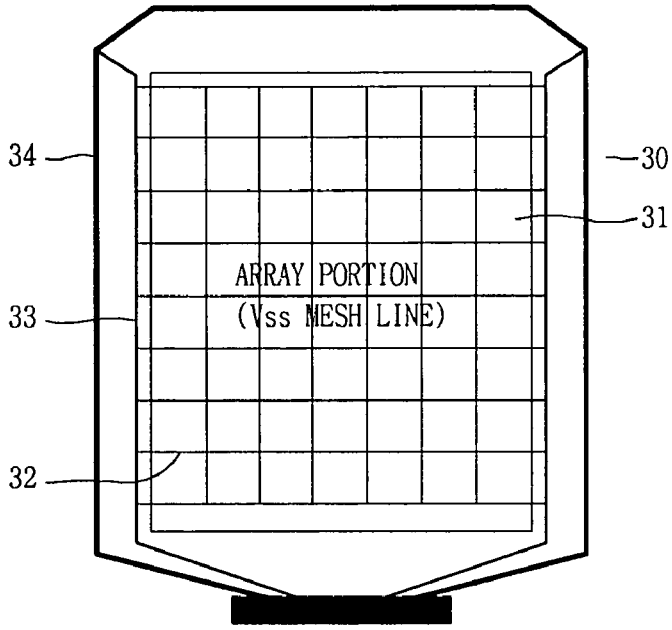
FIG. 3 is a schematic view showing an arrangement structure of power supply voltage supply lines on a display panel.
Figure 11:
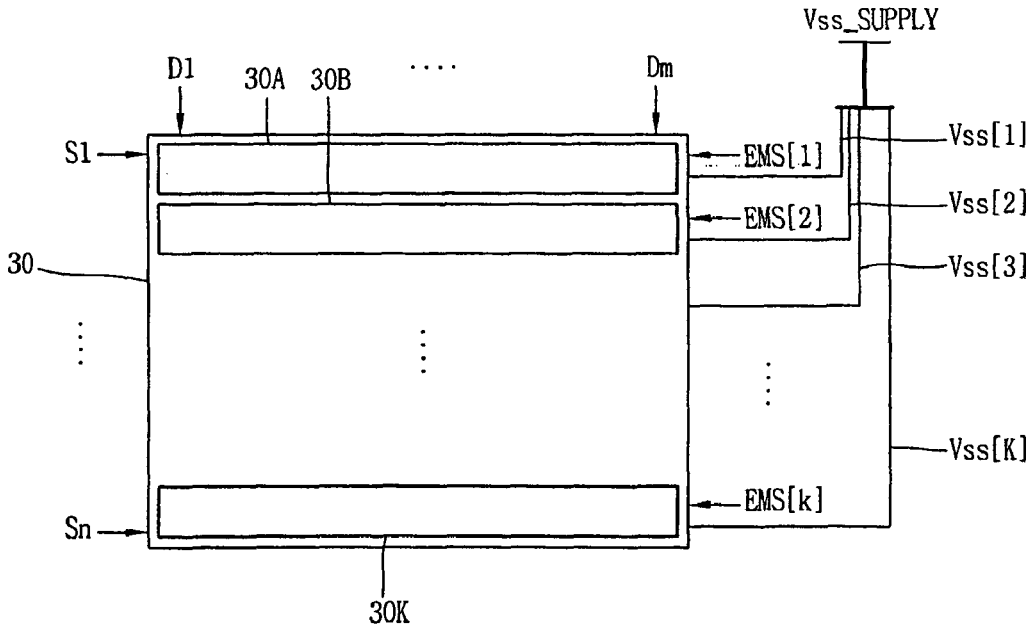
FIG. 11 is a view of a pixel circuit to which the pixel driving method according to additional embodiments of the invention.

FIG. 11 is a view of a pixel circuit to which the pixel driving method according to additional embodiments of the invention. Referring to FIG. 1, the display panel 30 is defined as a plurality of display panel regions 30A-30K in a horizontal direction so that a plurality of adjacent scan lines can be included. Pixels inside the plurality of display panel regions 30A-30K share one lower power supply voltage among a plurality of lower power supply voltages Vss[1]-Vss[K] supplied from the lower power supply voltage supply terminals (Vss_supply) by being diverged. A data voltage programming period and a data voltage emission period are determined in one frame period according to each of the display panel regions 30A-30K.

As shown in FIG. 11, scan lines S1-Sn and data lines D1-Dm are arrayed on the display panel 30 in the same manner as a general display panel. The display panel 30 is defined as a plurality of display panel regions 30A-30K in a horizontal direction so that a plurality of adjacent scan lines can be included. A plurality of lower power supply voltages Vss[1]-Vss[K] are supplied to the display panel regions 30A-30K, respectively. For instance, a large display panel 30 having 760 scan lines S1-Sn is defined as 10 display panel regions 30A-30K. Here, each of the ten display panel regions 30A-30K is implemented to include 76 scan lines {S1-S76,S77-S152 . . . S685-S760}. For reference, the display panel 30 of the invention has to be provided with 768 scan lines S1-Sn since it is implemented as an XGA-type (1024×768). However, the display panel 30 is supposed to have 760 scan lines for convenience.

Figure 12A:
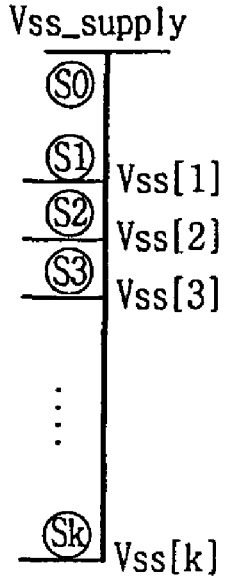
FIGS. 12A and 12B are exemplary views showing each lower power supply voltage.
Figure 12B:
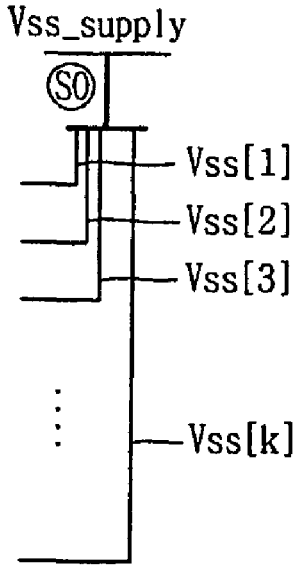
Figure 13:
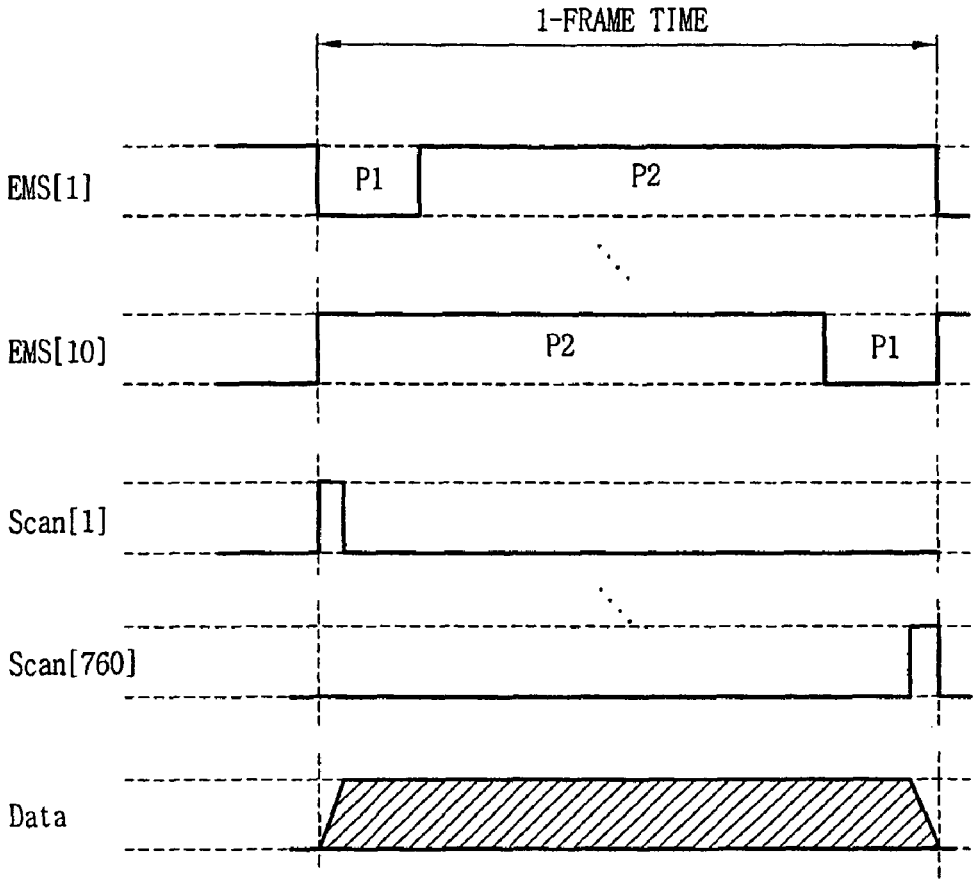
FIG. 13 is timing diagrams for a display panel driving according to additional embodiments of the invention.

The operation of the pixel driving apparatus for an organic light emitting device according to additional embodiments of the invention will be explained with reference to FIGS. 12A-12B and 13. FIGS. 12A and 12B are exemplary views showing each lower power supply voltage. FIG. 13 is timing diagrams for a display panel driving according to additional embodiments of the invention.

The lower power supply voltages Vss[1]-Vss[k] are respectively supplied to the display panel regions 30A-30K. FIGS. 12A and 12B show examples for distributing the lower power supply voltages Vss[1]-Vss[k]. Referring to FIGS. 12A and 12B, the lower power supply voltage Vss supplied through a main line connected to the lower power supply voltage supply terminal (Vss_supply) is distributed to 10 sub-lines (k=10). The lower power supply voltages Vss is supplied to 9 sub-lines among the 10 sub-lines, and a data voltage emission operation is performed at the other one sub-line by a switching control signal EMS in a state that supply of the lower power supply voltage Vss is cut off.

FIG. 12A is an exemplary view showing a method for obtaining lower power supply voltages Vss[1]-Vss[k] by sequentially diverging a power supplied to the lower power supply voltage supply terminal (Vss_supply) from an external power supply unit (not shown), and then for supplying the obtained lower power supply voltages Vss[1]-Vss[k] to each of the display panel regions 30A-30K. Here, due to distribution resistance values, voltages are diverged from distribution nodes S1-Sk in the order of "Vss[1]>Vss[2]>. . . Vss[k−1]>Vss[k]". Here, the previously diverged voltage is higher than the next one by a small degree.

Referring to FIG. 12B, a voltage of a common node S0 is expressed as a lower power supply voltage rising (Vss rising) by current applied to the diverged 9 lines. The Vss rising maintains a nearly constant value even if it varied little by little by an image change. FIG. 12B is an exemplary view showing a method for obtaining lower power supply voltages Vss[1]-Vss[k] by diverging a power supplied to the lower power supply voltage supply terminal (Vss_supply) from an external power supply unit (not shown) at the same position, and then for supplying the obtained lower power supply voltages Vss[1]-Vss[k] to each of the display panel regions 30A-30K. Here, since distribution resistance values are equal to each other, each of the lower power supply voltages Vss[1]-Vss[k] has the same level as the common node S0.

In an assumption that a voltage of SO varied at the gate according to a switching control signal EMS is $V_{SO}$, current of the rest display panel regions currently undergoing a light emitting operation can be expressed as the following equation 10.

$$I_{OLED} = \frac{\beta}{2}\cdot\{(V_{DATA}+\Delta V_{S0})-(V_{S0}+\Delta V_{S0})-V_{TH}\}^2 = \frac{\beta}{2}\cdot\{V_{DATA}-V_{S0}-V_{TH}\}^2 \quad \text{[Equation 10]}$$

Here, it can be seen that the current on the display panel regions currently performing a light emitting operation is not varied. Accordingly, the problem of the Vss rising is solved, thereby preventing non-uniformity of a brightness according to different positions on the large display panel 30.

The lower power supply voltages Vss[1]-Vss[k] are respectively supplied to the corresponding lower power supply voltage supply lines in the display panel regions 30A-30K by being diverged, as shown in FIG. 12B. For instance, in the display panel region 30A, the lower power supply voltage Vss1 is diverged into 76 lower power supply voltages in the same manner, as shown in FIG. 12B, and is supplied to the corresponding lower power supply voltage supply line.

FIG. 13 is timing diagrams for a display panel driving according to additional embodiments of the invention. FIG. 13 shows a data voltage programming period P1, a data voltage emission period P2, scan signals, and data voltages on the display panel regions 30A-30K to which the lower power supply voltages Vss[1]-Vss[k] are respectively supplied. More specifically, FIG. 13 shows examples of the data voltage programming period P1 and the data voltage emission period P2 with respect to each of the display panel regions 30A-30K. When the display panel 30 is defined as 10 display panel regions 30A-30K, 1/10 of one frame period is set as the data voltage programming period P1 with respect to each of the display panel regions 30A-30K, and the rest 9/10 of the one frame period is set as the data voltage emission period P2. Further, FIG. 13 shows exemplary timing diagrams of scan signals with respect to each of the display panel regions 30A-30K. Furthermore, FIG. 13 shows a timing diagram for data voltages supplied through data lines D1-Dn with respect to each of the display panel regions 30A-30K.

Based on the pixel circuit shown in FIG. 6, a display region (30A) among the display panel regions 30A-30K on the display panel 30 of FIG. 11, data voltage programming and emission operations will be explained. The data voltage programming period P1 is set with respect to the first display panel region 30A including all the pixels PXs connected to first to 76th scan lines G1-G76. As shown in FIG. 13, since a switching control signal EMS[1] of a 'low' level is applied to the gate of the switching transistor T43 inside all the pixels PXs connected to the first to $76^{th}$ scan lines G1-G76, the switching transistor T43 is turned OFF. Accordingly, the lower power supply voltage Vss from the lower power supply voltage supply line is not supplied to the corresponding pixel PX. The scan signals Scan[1]-Scan[76] are sequentially supplied to the first to $76^{th}$ scan lines G1-G76 in the data voltage programming period P1, thereby turning-ON the switching transistors T41 connected to the scan signals inside all the pixels PXs. As a result, data voltages DATA are supplied to the switching transistors T41 through the data lines D1-Dm. The data voltage DATA is charged onto each storage capacitor C41 through the switching transistors T41 inside the respective pixels PXs, and is maintained for the subsequent data voltage emission period P2. The data voltage programming and emission operations for the other display panel regions 30B-30K are subsequently performed in the same manner as the display panel region 30A. Accordingly, the data voltage programming period and the lighting duration of the organic light emitting diode can be sufficiently obtained regardless of the size of the display panel 30.

In the pixel driving method and apparatus for an organic light emitting device according to embodiments of the invention, in the data voltage programming period, a data voltage of a desired level can be precisely charged by charging the data voltage to the storage capacitor when the power supply voltage supplied to the organic light emitting diode is cut off. Also, in the data voltage emission period, the power supply to the OLED is started, thereby preventing a driving voltage of the driving transistor from changing. Accordingly, OLEDs having a non-uniform brightness can be prevented.

It will be apparent to those skilled in the art that various modifications and variations can be made in embodiments of the invention without departing from the spirit or scope of the invention. Thus, it is intended that embodiments of the invention cover the modifications and variations of this invention provided they come within the scope of the appended claims and their equivalents.

What is claimed is:

1. A pixel driving method for an organic light emitting device, comprising:

charging a data voltage supplied through a data line to a storage capacitor and driving an N-channel switching transistor while cutting off supply of an upper power supply voltage to an organic light emitting diode in data voltage programming period; and powering the organic light emitting diode to emit light by driving a first N-channel driving transistor by the data voltage charged onto the storage capacitor while supplying the upper power supply voltage to the light emitting diode in data voltage emission period, wherein a switching control signal is supplied to a gate of a second N-channel driving transistor during the data voltage programming period and thus supply the upper power supply voltage to the light emitting diode is cut off, wherein one side of the storage capacitor is connected to a gate of the first N-channel driving transistor, and another side of the storage capacitor is connected to a lower power supply voltage, wherein the first N-channel driving transistor has a drain connected to a source of the second N-channel driving transistor, and a source connected to the lower power supply voltage, wherein the second N-channel driving transistor has a drain connected to a cathode of the light emitting diode, and a source connected to the drain of the first N-channel driving transistor, wherein when a data voltage programming operation is completed, a first node where one side of the storage capacitor and the gate of the first N-channel driving transistor are connected to each other is in an electrical floating status, wherein a voltage of a second node is changed from the upper power supply voltage supplied during the data voltage emission period, the second node where the source of the first N-channel driving transistor and the lower power supply voltage are connected to each other, wherein when the voltage of the second node is changed during the data voltage emission period, the voltage of the first node is changed by coupling of the storage capacitor, thereby a voltage between gate and source terminals of the first N-channel driving transistor is not changed during the data voltage emission period, and wherein a driving current of the organic light emitting diode is not influenced by the second node, and is influenced by the data voltage stored in the storage capacitor.

2. The method of claim 1, wherein the N-channel switching transistor is driven by positive scan signals.

3. The method of claim 1, wherein the lower power supply voltage terminal is connected to a lower power supply voltage supply line having a mesh structure.

4. The method of claim 1, wherein the storage capacitor is connected between a gate terminal and a source terminal of the N-channel driving transistor.

5. The method of claim 1, wherein the organic light emitting diode has an anode connected to a source terminal of the N-channel driving transistor, and a cathode connected to a lower power supply voltage terminal.

6. The method of claim 1, wherein the organic light emitting diode has an anode connected to an upper power supply voltage terminal, and a cathode connected to a drain of the second N-channel driving transistor.

7. A pixel driving method for an organic light emitting device, comprising:

charging a data voltage supplied through a data line to a storage capacitor and driving a P-channel switching transistor while cutting off supply of a lower power supply voltage to an organic light emitting diode in data voltage programming period; and powering the organic light emitting diode to emit light by driving a first P-channel driving transistor by the data voltage charged onto the storage capacitor while supplying the lower power supply voltage to the organic light emitting diode in data voltage emission period, wherein the organic light emitting diode has an anode connected to a source terminal of the P-channel driving transistor, and a cathode connected to a lower power supply voltage terminal, wherein a switching control signal is supplied to a gate of a second P-channel driving transistor during the data voltage programming period and thus supply the lower power supply voltage to the light emitting diode is cut off, wherein one side of the storage capacitor is connected to a gate of the first P-channel driving transistor, and another side of the storage capacitor is connected to an upper power supply voltage, wherein the first P-channel driving transistor has a drain connected to a source of the second P-channel driving transistor, and a source connected to the upper power supply voltage, wherein the second P-channel driving transistor has a drain connected to an anode of the light emitting diode, and a source connected to the drain of the first P-channel driving transistor, wherein when a data voltage programming operation is completed, a first node where one side of the storage capacitor and the gate of the first P-channel driving transistor are connected to each other is in an electrical floating status, wherein a voltage of a second node is changed from the lower power supply voltage supplied during the data voltage emission period, the second node where the cathode of the organic light emitting diode and the lower power supply voltage are connected to each other, wherein when the voltage of the second node is changed during the data voltage emission period, the voltage of the first node is changed by coupling of the storage capacitor, thereby a voltage between gate and source terminals of the first P-channel driving transistor is not changed during the data voltage emission period, and wherein a driving current of the organic light emitting diode is not influenced by the second node, and is influenced by the data voltage stored in the storage capacitor.

8. The method of claim 7, wherein the P-channel switching transistor is driven by negative scan signals.

9. The method of claim 7, wherein the organic light emitting diode has an anode connected to a source terminal of the second P-channel driving transistor, and a cathode connected to a lower power supply voltage terminal.

* * * * *